United States Patent [19]

Simpson et al.

[11] Patent Number: 5,023,130

[45] Date of Patent: Jun. 11, 1991

[54] HYDROENTANGLED POLYOLEFIN WEB

[75] Inventors: Penny C. Simpson, Richmond, Va.; Larry M. Smith, Old Hickory, Tenn.

[73] Assignee: E. I. Du Pont de Nemours and Company, Wilmington, Del.

[21] Appl. No.: 567,207

[22] Filed: Aug. 14, 1990

[51] Int. Cl.[5] ..... D03D 3/00

[52] U.S. Cl. ..... 428/227; 28/104; 428/224; 428/299; 428/903

[58] Field of Search ..... 28/104; 428/299, 903, 428/224, 227

[56] References Cited

U.S. PATENT DOCUMENTS

| | | | |
|---|---|---|---|
| 3,169,899 | 2/1965 | Steuber | 161/72 |
| 3,403,862 | 10/1968 | Dworjanyn | 239/566 |
| 3,485,706 | 12/1969 | Evans | 161/72 |
| 4,091,137 | 5/1978 | Miller | 428/198 |
| 4,329,763 | 5/1982 | Alexander et al. | 28/104 |
| 4,910,075 | 3/1990 | Lee et al. | 428/224 |
| 4,920,001 | 4/1990 | Lee et al. | 428/289 |

OTHER PUBLICATIONS

"Protective Apparel of Du Pont Tyvek® Safety You Can Wear", Du Pont Bulletin, E-92145 (1987).

"Hydraulically Needled Tyvek® Filters", Research Disclosure, No. 20137, p. 106 (Feb. 1981).

"Tyvek® Softening Process", Research Disclosure, No. 21126, p. 403 (Nov. 1981).

*Primary Examiner*—James J. Bell

[57] ABSTRACT

A process is disclosed for hydroentangling continuous polyolefin filament fibers to form a fabric web. The fibers are supported on a 60 to 150 mesh screen and passed under high pressure water jets operating at at least 2000 psi and providing a total impact energy of at least 0.7 MJ-N/Kg to entangle the fibers. Preferably, the hydroentangled web is thereafter passed under finer finishing water jets operating at a pressure of between 300 to 1200 psi to redistribute the fibers. If desired, a finish may be applied to the entangled web. The resulting hydroentangled web has considerably increased visual uniformity, opacity, softness, comfort, strength and barrier properties compared to prior art webs thereby making it particularly useful as a disposable industrial garment.

13 Claims, 9 Drawing Sheets

FIG. 13

FIG. 14

HYDROENTANGLED POLYOLEFIN WEB

FIELD OF THE INVENTION

The present invention relates to an improved process for hydroentangling a polyolefin web and products produced thereby. In particular, the present invention relates to water jet entangling an unbonded, nonwoven polyethylene web to produce a durable yet extremely comfortable article of apparel.

BACKGROUND OF THE INVENTION

Spunbonded sheets of flash-spun polyolefin plexifilamentary film-fibril strands have been used in disposable industrial garments. Such sheets have been made commercially by E. I. du Pont de Nemours & Co. and sold as "Tyvek" spunbonded olefin. The sheets are known for their good strength, durability, opacity and ability to act as a barrier to particulate matter as small as submicron size. Because of these desirable characteristics, the spunbonded sheets have been fashioned into many types of industrial garments, such as those worn by asbestos workers, as disclosed in "Protective Apparel of Du Pont TYVEK®-SAFETY YOU CAN WEAR", E-02145, (1987). However, the utility of the garments could be greatly enhanced by improvements in the spunbonded sheet from which the garment is made in order to provide a softer and more breathable garment that is more comfortable to the wearer.

Various methods have been suggested for improving spunbonded polyethylene film-fibril sheets as well as spun webs of polyethylene fibers. One of these methods includes water jetting a spun web of fibers to add integrity to the web by entangling and interlocking the fibers in a random manner. This method is well known in the art and is described in Evans, U.S. Pat. No. 3,485,706, the contents of which are incorporated herein. In particular, Example 57 of Evans discloses the preparation of a fabric of high drape and suede-like properties made from a polyethylene nonwoven sheet. The process teaches depositing a three-dimensional network of polyethylene film-fibrils onto a collection belt and then lightly compacting the network by means of pressure rolls to provide a consolidated product having a paper-like hand. The product is then supported on a patterning plate (having 0.048 inch diameter holes in staggered array arranged on 0.08 inch centers) and subjected to high-energy streams of water issuing from a plurality of spaced orifices at between 1500 and 2000 psi. The use of high energy water jets is disclosed in Dworjanyn, U.S. Pat. No. 3,403,862, the contents of which are incorporated herein.

Moreover, U.S. Pat. No. 4,910,075 (Lee et al.) discloses a point-bonded, jet-softened polyethylene film-fibril nonwoven fabric useful as a disposable garment. This fabric is commercially available from E. I. du Pont de Nemours & Co. of Wilmington, Del. under the tradename TYPRO® PC. The process for preparing the nonwoven fabric comprises passing the sheet through a nip formed by a patterned, heated metal roll and a second, resilient roll to form a repeating boss pattern on the sheet and then subjecting the point-bonded sheet to high energy jets of water supplied from multiple closely-spaced orifices. The garments are comfortable and provide good protection against particulate matter.

However, the nonwoven fabrics described above are only suited for particular applications. These nonwoven fabrics have certain aesthetic and physical deficiencies which need improvement. Specifically, the strength and comfort of these nonwoven fabrics need to be improved so that the fabrics are more acceptable as an article of apparel.

Therefore, what is needed is a nonwoven fabric which provides an adequate degree of barrier and strength while also providing a very high degree of comfort based on heat and moisture vapor transmission. Other objects and advantages of the present invention will become apparent to those skilled in the art upon reference to the attached drawings and to the detailed description of the invention which hereinafter follows.

SUMMARY OF THE INVENTION

In accordance with the invention, there is provided a process for water jet entangling continuous polyolefin filament fibers in order to form a fabric web having considerable visual uniformity, opacity, softness, comfort, strength, and barrier properties. The process comprises hydroentangling an unbonded, nonwoven polyolefin, preferably polyethylene, web by supporting a lightweight polyolefin web of continuous polyolefin filament fibers on a fine mesh screen and passing the web under high energy water jets operating at a pressure of at least 2000 psi and producing a total impact energy of at least 0.7 MJ-N/Kg. Preferably, the high energy water jets operate at a pressure of at least 2100 psi and produce a total impact energy of between 0.8 and 1.6 MJ-N/Kg. Preferably, the entangled web is then passed under fine finishing water jets operating at lower pressures, namely from about 300 to about 1200 psi, to redistribute the fibers. Thereafter, the entangled web may be passed through a pad process where various finishes may be applied. Non-limiting examples of such finishes include hydrophilic finishes, hydrophobic finishes, surface stabilizers, wetting agents, disperse dyes and acrylic binders.

By using bonding technology that does not require heat and rolling pressure, a product can be produced by the above-identified process which eliminates the poor aesthetics common among prior art fabrics. The problems of stiff, paper-like hand and plastic-like texture inherent in the prior art, are eliminated when the web is hydroentangled with very high energy water jets thereby giving it vastly improved strength and comfort. By entangling the web with high energy water jets, the fibers are intermingled to form stronger, more durable webs. In fact, the resulting webs have strengths similar to bonded polyethylene sheets (e.g., TYVEK® 1422, commercially available from E. I. du Pont de Nemours and Company of Wilmington, Delaware) yet have a uniquely high comfort level, soft hand and improved drapeability. Many of the physical differences can be observed visually as well as by measuring properties which are inherent in the web.

As used herein, "fine mesh screen" means that the screen is between 60 and 150 mesh, preferably between 75 and 100 mesh. Mesh sizes of less than 60 are too large and cause dimples or holes to form in the hydroentangled product while mesh sizes above 150 are too closed and don't permit adequate water drainage through the fabric web and the screen.

BRIEF DESCRIPTION OF THE DRAWINGS

The invention will be better understood with reference to the following figures:

FIG. 13 shows a 1.56 oz./yd$^2$ fabric web of TK-2850 sample 2 produced by the inventive process.

FIG. 14 shows a 1.56 oz./yd$^2$ fabric web of TK-2850 sample 3 produced by the inventive process.

DETAILED DESCRIPTION OF THE PREFERRED EMBODIMENTS

Figure 1:
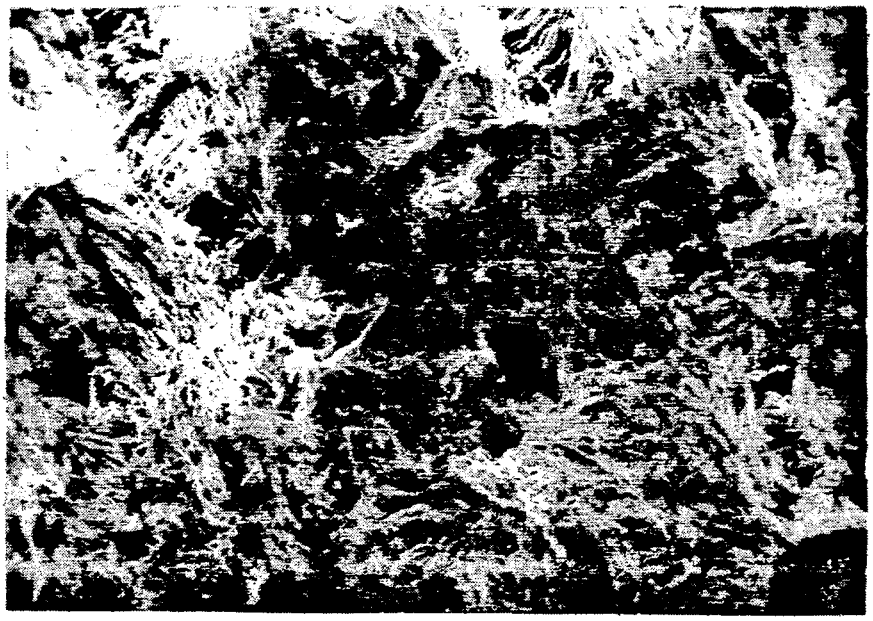
FIG. 1 is a scanning electron microscope photo at 20× of a 1.9 oz./yd$^2$ polyethylene web produced by Example 57 of Evans.
Figure 2:
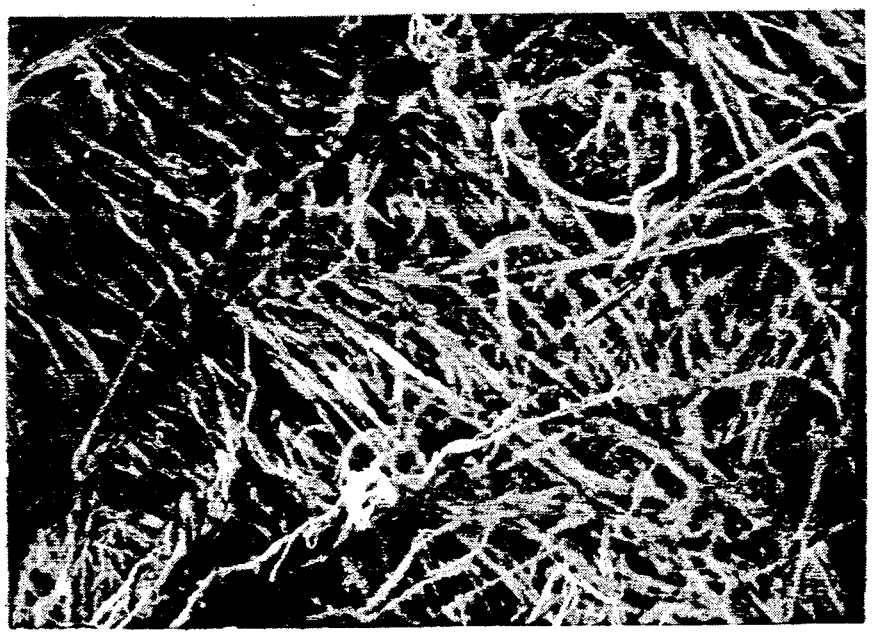
FIG. 2 is a scanning electron microscope photo at 200× of a 1.9 oz./yd$^2$ polyethylene web produced by Example 57 of Evans.
Figure 3:
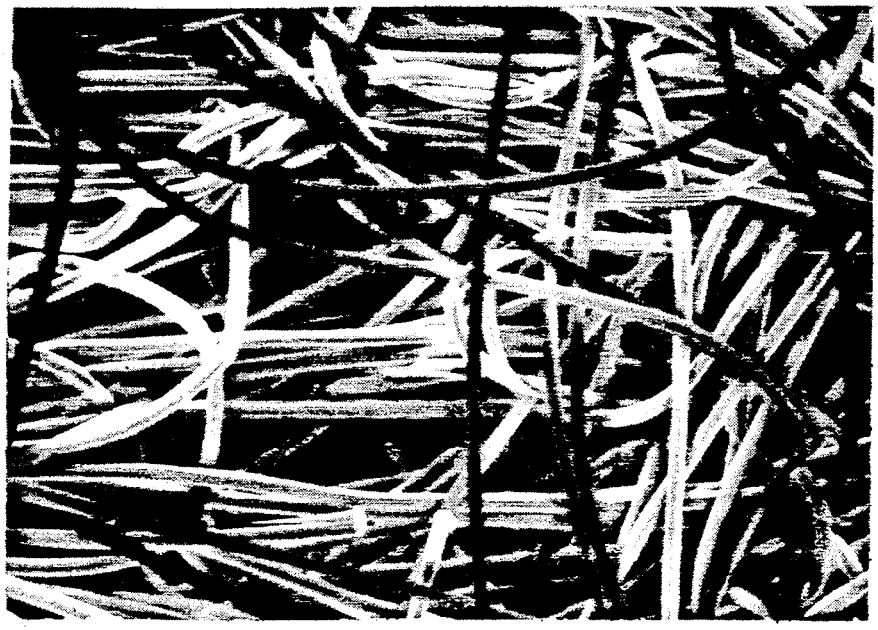
FIG. 3 is a scanning electron microscope photo at 200× of a 1.6 oz./yd$^2$ Sontara® web (Style No. 8004) produced by the commercial Sontara® process.

The starting material for the process of the present invention is a lightly consolidated flash-spun polyolefin, preferably polyethylene, plexifilamentary film-fibril web produced by the general procedure of Steuber, U.S. Pat. No. 3,169,899. According to the preferred method for making the starting sheets, a linear polyethylene having a density of 0.96 g/cm$^3$, a melt index of 0.9 (determined by ASTM method D-1238-57T, condition E) and a 135° C. upper limit of its melting temperature range is flash spun from a 12 weight percent solution of the polyethylene in trichlorofluoromethane. The solution is continuously pumped to spinneret assemblies at a temperature of about 179° C. and a pressure above about 85 atmospheres. The solution is passed in each spinneret assembly through a first orifice to a pressure let-down zone and then through a second orifice into the surrounding atmosphere. The resulting film fibril strand is spread and oscillated by means of a shaped rotating baffle, is electrostatically charged and then is deposited on a moving belt. The spinnerets are spaced to provide overlapping, intersecting deposits on the belt to form a wide batt. The batt is then lightly consolidated by passage through a nip that applies a load of about 1.8 kilograms per cm of batt width. Generally, thusly formed lightly consolidated webs having a unit weight in the range of 25 to 70 grams per square meter are suitable for use in the process of the present invention.

Referring now to the figures, a number of scanning electron microscope photos and samples of webs produced by the inventive process and webs produced by processes of the prior art are shown. The photos and samples will be more fully described in the following examples. The examples illustrate the improved properties of webs produced by the inventive process compared to those webs produced by processes of the prior art. Although the water jetting of a polyolefin web is not new, the webs formed by water jetting at conditions not disclosed by the prior art display physical properties and product features that are significantly different. These differences are set forth in Tables 1, 2 and 3 for the inventive webs (samples 1–4) versus TYVEK® 1422A, Example 57 of Evans, Sontara® and TYPRO® PC:

TABLE 1

| Sample | Basis Weight (oz/yd$^2$) | Strip Tensile Strength (lbs/oz/yd$^2$) | % Elongation | Work-to-Break (in-lbs/oz/yd$^2$) |
|---|---|---|---|---|
| TYVEK® 1422A | 1.2 | 5.9 | 7.77 | 1.775 |
| Evans Ex. 57 | 1.9 | 3.03 | 28.96 | 2.201 |
| Sontara® | 1.6 | 9.13 | 25.8 | 7.974 |
| TYPRO® PC | 1.2 | 4.68 | 12.73 | 1.797 |
| TK-2850 1 | 1.56 | 6.45 | 31.09 | 7.89 |
| TK-2850 2 | 1.56 | 5.17 | 25.72 | 5.301 |
| TK-2850 3 | 1.56 | 3.82 | 30.87 | 6.552 |
| TK-2850 4 | 1.56 | 5.35 | 27.73 | 5.600 |

TABLE 2

| Sample | Frazier (cfm/ft$^2$) | Opacity (%) | Crock (# strokes) | Pore Size (microns) Min. | Max. | MFP |
|---|---|---|---|---|---|---|
| TYVEK® 1422A | N/A | 95.4 | 7 | 2.86 | 6.46 | 2.95 |
| Evans Ex. 57 | 34.9 | 95.91 | 8 | 7.26 | 124 | 8.12 |
| Sontara® | 146.5 | 52.5 | 3.5 | 22.6 | 154 | 42.8 |
| TYPRO® PC | 9.56 | 94.4 | 6 | 6.29 | 29.4 | 7.73 |
| TK-2850 1 | 10.2 | 95.1 | 2.6 | 6.52 | 31.2 | 8.69 |
| TK-2850 2 | 10.1 | 96.4 | 3.7 | 5.63 | 40.9 | 7.34 |
| TK-2850 3 | 9.25 | — | 2 | 5.30 | 17.6 | 6.32 |
| TK-2850 4 | 14.6 | 95.5 | 2 | 4.53 | 30.4 | 8.58 |

TABLE 3

| Sample | Talc Barrier # particles/min. (>0.5 microns) | % holdout* | # particles/min. (>1.0 micron) | % holdout* |
|---|---|---|---|---|
| TYVEK® | 1.6 | 99.998 | 0.6 | 99.999 |

TABLE 3-continued

| Sample | Talc Barrier # particles/min. (>0.5 microns) | % holdout* | # particles/min. (>1.0 micron) | % holdout* |
|---|---|---|---|---|
| 1422A | | | | |
| Evans Ex. 57 | 98,679 | 0 | 75,746 | 6 |
| Sontara ® | 94,018 | 0 | 80,407 | 0 |
| TYPRO ® PC | 188 | 99.80 | 47 | 99.9 |
| TK-2850 1 | 4,236 | 95.5 | 3,183 | 96 |
| TK-2850 2 | 1,753 | 98.1 | 1,290 | 98.4 |
| TK-2850 3 | 6.8 | 99.99 | 2.1 | 99.998 |
| TK-2850 4 | 1,620 | 98.3 | 808 | 99 |

*Relative to Sontara ® @ 0% holdout as a reference - In reality, Sontara ® holds out about 40% of asbestos particles based on independent lab testing.

The following test procedures were employed to determine the various characteristics and properties reported above. ASTM refers to the American Society of Testing Materials. TAPPI refers to the Technical Association of the Pulp and Paper Industry. AATCC refers to the American Association of Textile Colorists and Chemists.

Basis weight was determined by ASTM D-3776-85. Strip tensile strength was determined by ASTM D 1117. Frazier porosity was determined by ASTM D737-75. Opacity was determined by TAPPI T-245 M-60. Color fastness to crocking was determined by AATCC crockmeter method 8-1985.

Pore size was determined using a Coulter Porometer commercially available from Coulter Electronics Limited, Luton Beds., England. The sample to be analyzed was thoroughly wetted so that all accessible pores were completely filled with liquid. The wetted sample was then placed in the sample body of the filter holder assembly, secured with a locking ring and the pore size value was recorded.

Barrier was determined using a talc powder particle counter. A 10 cm×28 cm rectangular sample was placed over dual orifices of a sealable box containing talc powder. An external pump was used to force talc powder out of the box and through the sample. A particle counter reported the number of particles per minute that passed through the sample at a specific particle size range. Each sample was tested numerous times at each particle size range counted so that an average value could be calculated.

In the inventive process, the webs are subjected to high energy, high impact jets of water delivered through closely-spaced small orifices. The jets impart to the web a total impact-energy product ("I×E") of at least 0.7 megaJoule-Newton per kilogram(MJ-N/Kg). Preferably, the jets impart to the web a total impact-energy product ("I×E") in the range of 0.8 to 1.6 megaJoule-Newtons per kilogram. Equipment of the general type disclosed in the above-mentioned Evans and Dworjanyn patents is suitable for the water-jet treatment.

The energy-impact product delivered by the water jets impinging upon the web is calculated from the following expressions, in which all units are listed in the "English" units in which the measurements reported herein were originally made so that the "I×E" product was in horsepower-pounds force per pound mass, which then was converted to megaJoule-Newtons per kilogram by multiplying the English units by 26.3:

$$I = PA$$

$$E = PQ/wzs$$

wherein:
I is impact in lbs force
E is jet energy in horsepower-hours per pound mass
P is water supply pressure in pounds per square inch
A is cross-sectional area of the jet in square inches
Q is volumetric water flow in cubic inches per minute
w is web weight in ounches per square yard
z is web width in yards and
s is web speed in yards per minute.

The major difference between prior art hydroentangling processes and the process of the instant invention is the manner in which the web is jetted. Prior art processes (e.g., TYPRO ® PC and Sontara ®) start at low pressures and impact energies and build up slowly. This is done in the Sontara ® process so the discrete fibers aren't blown off the screen and in the TYPRO ® PC process so the point-bonded web is not delaminated. Conversely, in the inventive process, high water jet pressure and impact energy are used to entagle the fibers so that the long continuous strands aren't greatly disturbed to the point where ropes and thin areas are formed. Ropes and thin areas greatly reduce uniformity and the barrier properties of the entangled web.

The following examples further illustrate the differences in jetting between the inventive process and the prior art processes:

Prior Art

| Evans Ex. 57 | Jet Type* | Pressure Side 1 | I × E | Pressure Side 2 | I × E |
|---|---|---|---|---|---|
| Jet 1 | (5/20) | 2,000 psi | .5865 | 2,000 psi | .5865 |
| Jet 2 | " | " | " | " | " |
| Jet 3 | " | " | " | " | " |
| Jet 4 | " | " | " | " | " |
| Jet 5 | " | " | " | " | " |
| Jet 6 | " | " | " | " | " |
| Jet 7 | " | " | " | " | " |
| Jet 8 | " | " | " | " | " |

Total I × E = 9.38 MJ-N/Kg

The web was run at a speed of 5 yards per minute under 8 jets of 0.005 inch orifices spaced 20 per inch per side in the same manner as disclosed in Example 57 and using a patterning screen having 0.048 inch diameter holes in staggered array arranged on 0.08 inch centers.

| TYPRO ® PC | Jet Type* | Pressure Side 1 | I × E | Pressure Side 2 | I × E |
|---|---|---|---|---|---|
| Jet 1 | (5/40) | 300 psi | .0078 | 300 psi | .0078 |
| Jet 2 | " | off | | 1000 psi | .0182 |
| Jet 3 | " | 1500 psi | .0496 | 1400 psi | .0418 |
| Jet 4 | " | off | | off | |
| Jet 5 | " | 1500 psi | .0496 | 1400 psi | .0418 |

Total I × E = 0.2166 MJ-N/Kg

The web was run at a speed of 40 yards per minute under 5 jets of 0.005 inch orifices spaced 40 orifices per inch per side. Side 1 had a 75 mesh screen and side 2 had a 100 mesh screen.

Inventive Samples

| TK-2850 1 | Jet Type* | Pressure Side 1 | I × E | Pressure Side 2 | I × E |
|---|---|---|---|---|---|
| Jet 1 | (5/42) | 2175 psi | .2314 | 2175 psi | .2314 |
| Jet 2 | (4/51) | 2610 psi | .1816 | 2610 psi | .1816 |

Total I × E = 0.826 MJ-N/Kg

The web was run at a speed of 44 yards per minute under 2 jets with a combination of 0.004 inch orifices spaced 51 orifices per inch and 0.005 inch orifices spaced 42 orifices per inch. Side 1 and side 2 had 100 mesh screens.

| TK-2850 2 | Jet Type* | Pressure Side 1 | I × E | Pressure Side 2 | I × E |
|---|---|---|---|---|---|
| Jet 1 | (5/42) | 2175 psi | .2314 | 2175 psi | .2314 |
| Jet 2 | (4/51) | 2900 psi | .2364 | 2900 psi | .2364 |

Total I × E = 0.9356 MJ-N/Kg

The parameters were the same as in TK-2850 sample 1.

| TK-2850 3 | Jet Type* | Pressure Side 1 | I × E | Pressure Side 2 | I × E |
|---|---|---|---|---|---|
| Jet 1 | (5/40) | 2000 psi | .1787 | 2000 psi | .1787 |
| Jet 2 | (4/80) | 400 psi | .0026 | 400 psi | .0026 |
| Jet 3 | (5/40) | 2000 psi | .1787 | 2000 psi | .1787 |
| Jet 4 | (4/80) | 400 psi | .0026 | 400 psi | .0026 |

Total I × E = 0.725 MJ-N/Kg

The web was run at a speed of 40 yards per minute under 4 jets with a combination of 0.005 inch orifices spaced 40 orifices per inch and 0.004 inch orifices spaced 80 orifices per inch. Side 1 had a 100 mesh screen and side 2 had a 75 mesh screen.

| TK-2850 4 | Jet Type* | Pressure Side 1 | I × E | Pressure Side 2 | I × E |
|---|---|---|---|---|---|
| Jet 1 | (5/24) | 2100 psi | .1210 | 2500 psi | .1873 |
| Jet 2 | (5/40) | 2100 psi | .2018 | 2100 psi | .2018 |
| Jet 3 | (5/40) | 2100 psi | .2018 | 2500 psi | .3122 |
| Jet 4 | (4/80) | 400 psi | .0026 | 400 psi | .0026 |

Total I × E = 1.23 MJ-N/Kg

*Jet type means (orifice diameter in mils/# of orifices per inch (1 mil = .00254 cm))

The web was run at a speed of 40 yards per minute under 4 jets with a combination of 0.005 inch orifices spaced 24 orifices per inch, 0.005 inch orifices spaced 40 orifices per inch and 0.004 inch orifices spaced 80 orifices per inch. Side 1 had a 100 mesh screen and side 2 had a 75 mesh screen.

The desired impact energy products can be achieved by operating with the initial water jet treatment step under the following conditions. Webs can be treated from one or both sides of the web by closely spaced jet orifices of small diameter. Strips of jets can be located between 0.6 to 7.5 cm above the sheet being treated and arranged in rows perpendicular to the movement of the web. Each row can contain between 4 and 31 jet orifices per centimeter. Orifice diameters in the range of about 0.10 to 0.18 mm are suitable. The orifices must be supplied with water at a pressure of at least 2000 psi. However, the orifices are preferably supplied with water at a pressure of at least 2100 psi. The web is supported on a fine mesh screen, preferably between 75 and 100 mesh. Depending on the web speed, which can range from 5 to 200 yards per minute, the other parameters are adjusted to provide the impact energy product needed in accordance with the invention to provide the desired degree of softening for the web. For purposes of the invention, the applicants have found that the impact energy product must at least total 0.70 MJ-N/Kg. It is to be noted that fine finishing jets operating at lower pressure (e.g., jet 4 of TK-2850 sample 4 above) can be used as a preferred second process step to redistribute the hydroentangled fibers.

COMPARATIVE EXAMPLES

Webs made by the inventive process are set out against prior art webs in the following comparisons:

Inventive Webs vs. TYVEK ® 1422A

The inventive webs have improved visual uniformity, increased softness, drapability and textile-like hand than commercially available TYVEK ® 1422A Due to the surface and structural differences, the comfort level is much higher and the breathability is greater in the inventive webs. Moreover, the greatly increased elongation provides the inventive webs with a much higher work-to-break strength than the TYVEK ® 1422A product.

Inventive Webs vs. Evans Example 57

When the inventive webs are compared to Example 57 of the Evans patent, significant visual differences are present. Although the basis weight in Example 57 of Evans was 1.9 oz./yd$^2$ and the basis weight for inventive samples 1–4 was 1.56 oz/yd$^2$, the web of Example 57 was extremely nonuniform having holes located throughout the fabric. (See FIG. 9). This occurred due to the high pressure jets of water (issuing at 2000 psi) hitting the raised knuckles of the coarse patterning screen and removing fibers in those areas.

Figure 9:
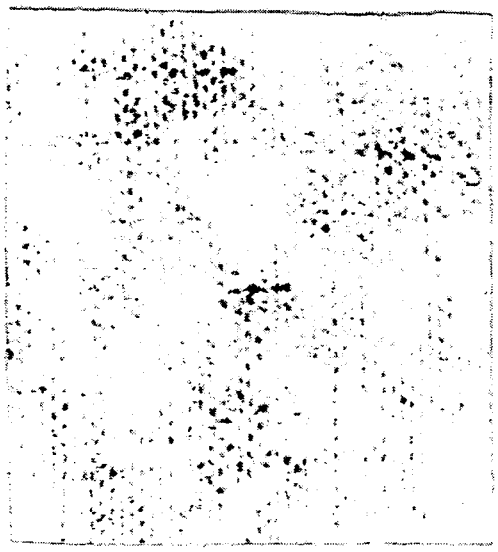
FIG. 9 shows a 1.9 oz./yd: polyethylene fabric web made by Example 57 of Evans.
Figure 10:
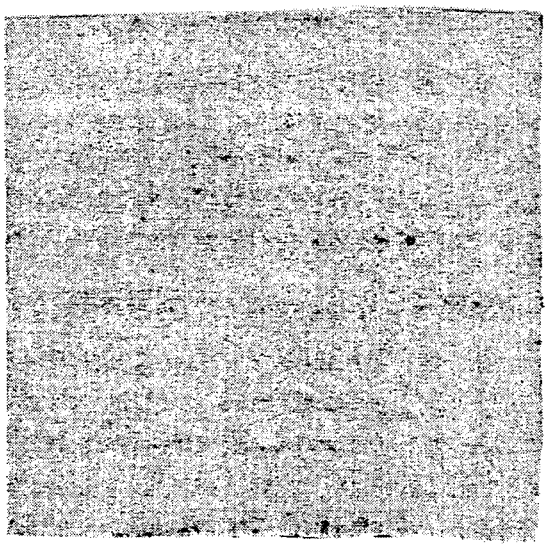
FIG. 10 shows a 1.6 oz./yd$^2$ fabric of Sontara® comprising 100% 1.35 dpf, 0.86 inch long polyester discrete fibers of type 612.
Figures 11, 12:
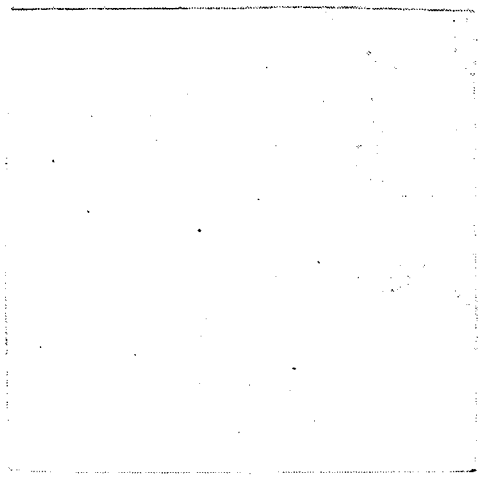
FIG. 11 shows a 1.2 oz./yd$^2$ fabric web of TYPRO® PC.
FIG. 12 shows a 1.56 oz./yd$^2$ fabric web of TK-2850 sample 1 produced by the inventive process.
Figures 15, 16:
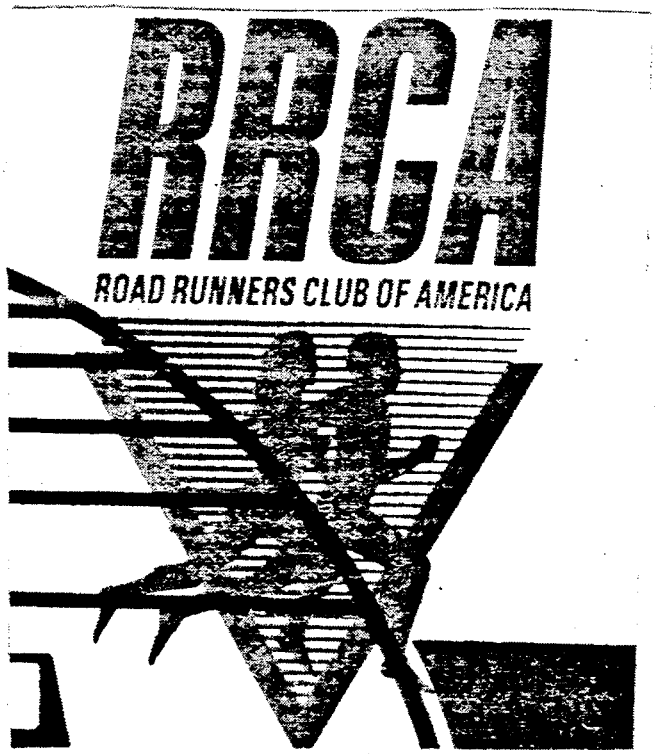
FIG. 15 shows a 1.56 oz./yd$^2$ fabric web of TK-2850 sample 4 produced by the inventive process.
FIG. 16 shows a TYPRO® PC web having printing thereon.

Another visual difference is the surface pattern imprinted onto the fabric by the patterning screen. FIG. 9 (Example 57) shows a definite dimple pattern very similar to a paper towel. Conversely, the inventive webs (FIGS. 12–15) are quite smooth and uniform resembling a suede or silk-like fabric. Due to the smoother surface, the inventive webs are easy to print using a silk screen process and show distinct print clarity. These are highly desired features for consumer specialty fabrics.

The inventive webs also exhibit greater tensile strength and work-to-break values than Example 57. Example 57 has poor uniformity causing dry particulate matter to more easily pass through the small hole areas of the web making the overall barrier unsuitable for a protective apparel fabric and other apparel end uses. However, the inventive webs are produced under process conditions that produce a very uniform product (i.e., few holes) having a much higher level of barrier.

Inventive Webs vs. Sontara®

When web samples made by the inventive process (TK-2850 samples 1–4) are compared to a Style 8004 Sontara® fabric (i.e., a water jet entangled fabric comprised of 100% 1.35 dpf, 0.86 inch long discrete polyester fibers of type 612) at a basis weight of 1.6 oz./yd$^2$, the inventive webs have a significantly higher level of barrier protection due to their denser mesh of fibers and resulting finer pore size distribution. Sontara® fabrics are routinely used for disposable hospital gowns. Barrier protection is a significant requirement in most industrial apparel end uses. The webs of the inventive process also have a much higher level of opacity than those of the Sontara® fabric (95% versus 52%). The inventive webs provide a texture similar to a textile fabric while the Sontara® fabric could not produce such a texture without interlacing additional filler fibers or by using much higher basis weights. Moreover, due to the poor opacity of the Sontara® fabric, it could not be used suitably for printing while the inventive webs produce a remarkably good printing substrate.

Inventive Webs vs. TYPRO® PC

The inventive webs have much different physical properties than webs of TYPRO® PC. The inventive webs are more visually uniform, smoother, softer and have a better print clarity than the PC web. A major advantage is the work-to-break value of the inventive webs (i.e., 3 to 4 times as great) to that of the PC web. The comfort level for the inventive webs is about 6.0 on the Goldman comfort scale compared to the 4.0 value of the PC web. The Goldman comfort scale measures physiological comfort and is determined by the fabric's insulating value and moisture permeability. The scale subjectively measures the degree of comfort provided to a wearer of a disposable protective garment made with nonwoven fabric. In fact, the comfort level of the inventive webs approaches that of typical woven polyester work clothing (7.0 measured on the Goldman scale).

Figure 4:
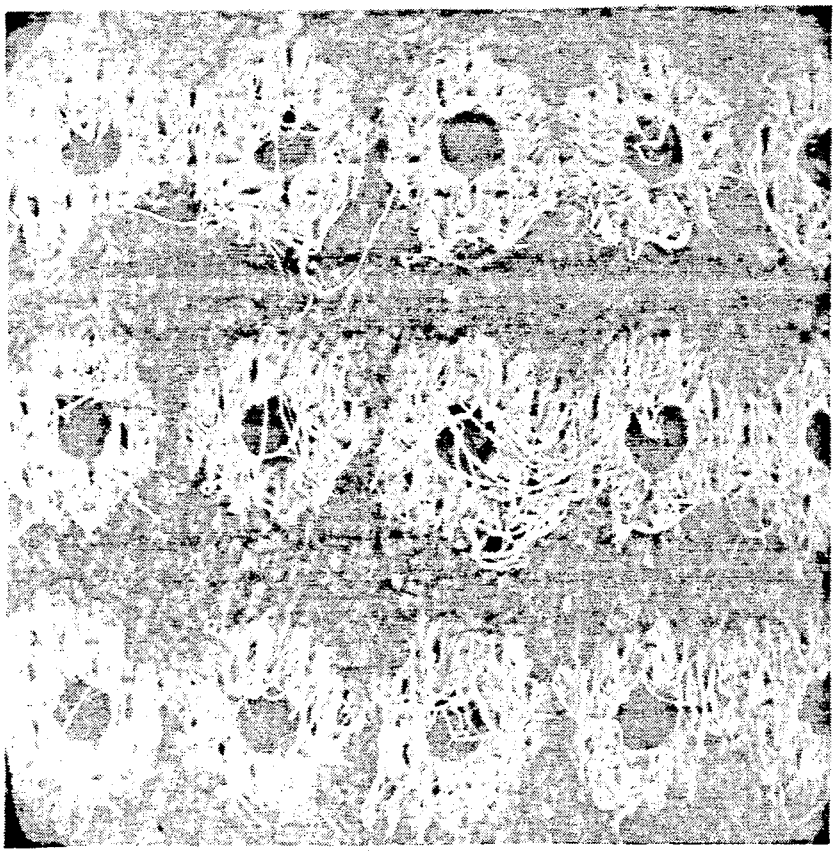
FIG. 4 is a scanning electron microscope photo of a 1.2 oz./yd$^2$ point-bonded web produced by the commercial TYPRO® PC process showing "craters".
Figure 5:
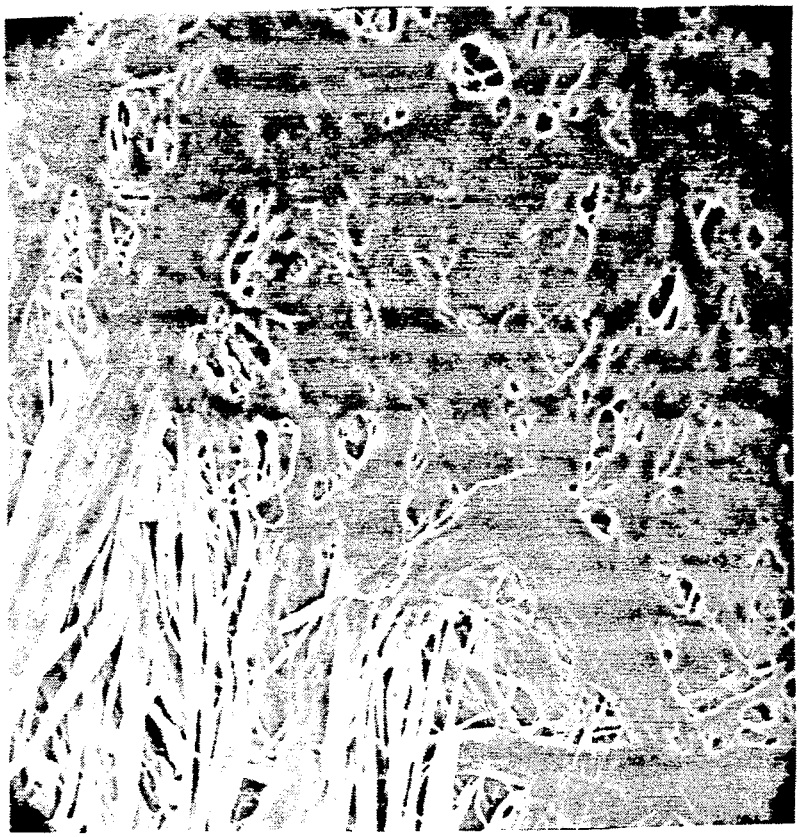
FIG. 5 is another scanning electron microscope photo of a web produced by the commercial TYPRO® PC process.
Figure 6:
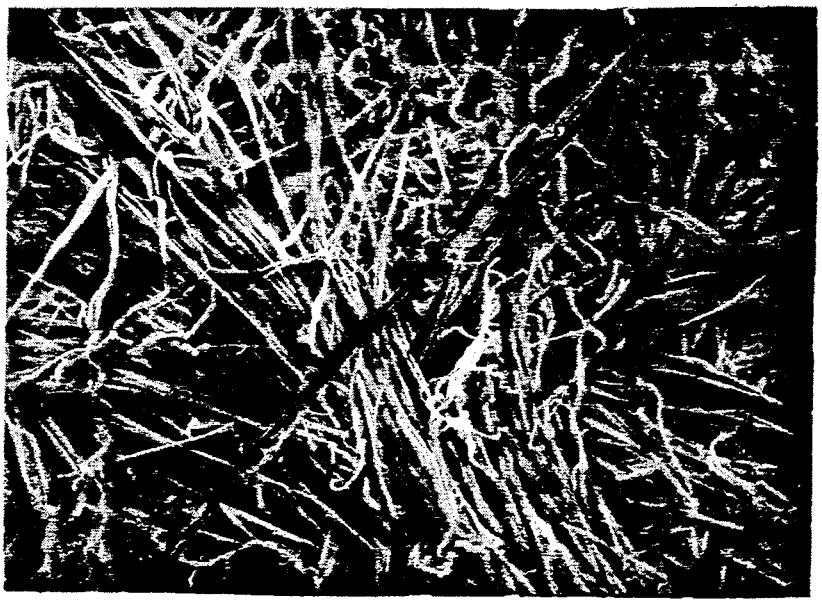
FIG. 6 is a scanning electron microscope photo at 200× of TK-2850 sample 1 produced by the inventive process.
Figures 7, 8:
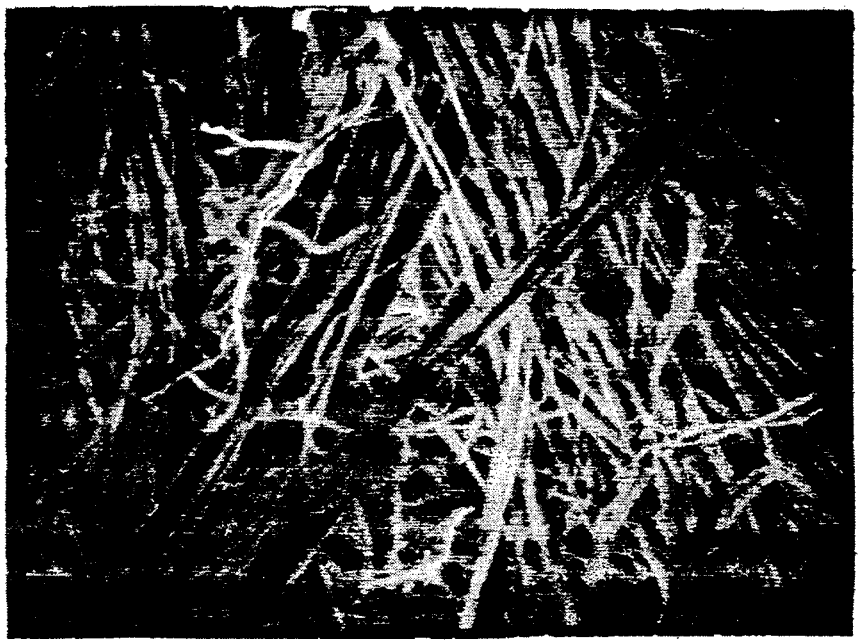
FIG. 7 is a scanning electron microscope photo of the sample of FIG. 6 except at 500×.
FIG. 8 shows a 1.2 oz./yd$^2$ commercial fabric of TYVEK® 1422A.

The basic physical structure of the inventive webs is different from the PC web as well. As seen in the scanning electron microscope photos (FIGS. 4 and 5), the PC web's ability to transport heat and moisture vapor is due to the discrete capillary channels formed in specific areas, "craters" covering 40% of the surface area per side, formed when water jets disrupt the lightly bonded areas around each P and C. bond site. Conversely, the absence of bonding in the inventive process (see FIGS. 6 and 7) results in the entire surface area having the ability to transport heat and moisture vapor, hence greater comfort to the wearer.

Figure 17:
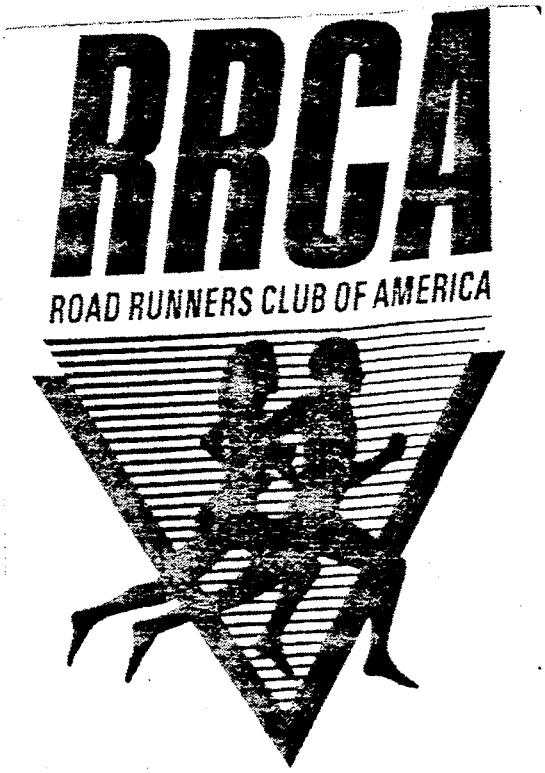
FIG. 17 shows a fabric web produced by the inventive process having printing thereon.

The surface texture is even more noticeably different after dyeing and/or printing. Due to the inherent surface smoothness and uniformity of the inventive webs, the substrate enhances print clarity and produces a more precise image. This is readily apparent by comparing FIG. 16 (TYPRO® PC) and FIG. 17 (inventive web).

As noted above, the inventive process of water jetting a spun web of polyethylene fibers adds integrity to the web by entangling and interlocking the fibers in a random manner. This increases levels of breathability, tensile strength, % elongation, work-to-break and surface abrasion resistance. The resulting web is suitable for limited use nonwoven and specialty textile fabrics. The entangled web exhibits a unique combination of desirable and useful features which are absent in the prior art. In addition, the web combines the soft, smooth, suede-like texture of a woven fabric with outstanding tensile strength, % elongation, and work-to-break. A high level of comfort, as measured by heat and moisture transport (via the Goldman comfort test), is achieved along with high opacity and good barrier protection from dry particulate matter. Due to its smooth surface and uniformity, the web also has high print clarity which is extremely desirable in the area of consumer apparel.

In particular, the inventive process optimizes both barrier and surface stability by using a combination of parameters (e.g., jets and pressures) that first entangle the fibers and then preferably uniformly redistribute them. This is accomplished by first entangling the web using relatively large jet diameters at a fairly large spacing and high pressures and then following up with finer jet diameters at a closer spacing and lower pressures to redistribute the fibers and close up the random open spaces between fibers. Alternatively, barrier and surface stability can be optimized by entangling the web using very fine diameter jets at fairly close spacing using very high pressures. The inventive process utilizes screens that are much finer (60 to 150 mesh) than those of the prior art (i.e., Example 57 of Evans). This reduces the tendency of the jets to move fibers over the knuckles of the screen and cause holes.

If desired, an additional improvement in wearer comfort of garments made from webs of the invention can be achieved if a finish is applied to the hydroentangled web. In particular, a hydrophilic or hydrophobic finish may be applied as follows:

A hydrophilic finish bath composition was prepared from the following components by weight:

| Component | Weight % | Description |
|---|---|---|
| Blue GLF | 0.3% | Disperse dye |
| Apcorez 631 | 1.6% | Acrylic binder (Apollo Chemical Co.) |
| Zelec TY | 1.3% | Antistatic agent (E. I. du Pont de Nemours & Co.) |
| MPD 7456 | 0.4% | Wetting agent-mixture of Merpol A and Dupanol C (E. I. du Pont de Nemours & Co.) |
| Rhoplex 1402 | 1.6% | Acrylic binder (Rohm & Haas Co.) |
| Water | 94.8% | |

A hydrophobic finish bath composition was prepared from the following components by weight:

| Component | Weight % | Description |
|---|---|---|
| Zepel 7040 | 4.0% | Non-ionic fluoropolymer rain/stain repellant (E. I. du Pont de Nemours & Co.) |
| Isopropanol | 20.0% | |
| Water | 76.0% | |

The finish compositions can be applied to the web by the process disclosed in U.S. Pat. No. 4,920,000 (Lee et al.), the contents of which are incorporated herein.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A process for hydroentangling an unbonded, nonwoven polyolefin web comprising the steps of:

(a) supporting a lightweight web of continuous polyolefin filament fibers on a fine mesh screen; and (b) passing the supported web underneath high energy water jets operating at a pressure of at least 2000 psi and providing a total impact energy of at least 0.7 MJ-N/Kg to entangle the web in a random manner.

2. A process according to claim 1 further comprising passing the hydroentangled web of step (b) underneath finishing water jets operating at 300 to 1200 psi to redistribute the randomly entangled fibers.

3. A process according to claim 1 wherein the high energy jets operate at a pressure of at least 2100 psi.

4. A process according to claim 1 wherein the high energy jets provide a total impact energy of between 0.8 and 1.6 MJ-N/Kg to the web.

5. A process according to claim 1 further comprising the step of applying a finish to the hydroentangled web.

6. A process according to claim 5 wherein the finish is selected from the group consisting of hydrophilic finishes, hydrophobic finishes, disperse dyes, surface stabilizers, wetting agents and acrylic binders.

7. A process according to claim 1 wherein the web is supported on a 75 or 100 mesh screen.

8. A process according to claim 1 wherein the polyolefin web is comprised of plexifilaments.

9. A process according to claim 1 wherein the polyolefin comprises polyethylene.

10. An unbonded, nonwoven polyolefin web produced by the process of any of claims 1–9.

11. An unbonded, nonwoven hydroentangled polyolefin web having a strip tensile strength of at least 3.5 lbs/oz/yd$^2$, an opacity of at least 90%, and an average pore size of less than 10 microns.

12. A hydroentangled web according to claim 11 further having a comfort rating of at least 5.0.

13. A hydroentangled web according to claim 11 wherein the polyolefin comprises polyethylene.

* * * * *